US011358191B2

(12) United States Patent
Freliez et al.

(10) Patent No.: US 11,358,191 B2
(45) Date of Patent: Jun. 14, 2022

(54) DEVICE FOR DRYING A METAL STRIP

(71) Applicant: FIVES DMS, Noyelles-les-Seclin (FR)

(72) Inventors: Jérémie Freliez, Villeneuve d'ascq (FR); Jean Mestdagh, Allennes-les-marais (FR)

(73) Assignee: FIVES DMS, Noyelles-les-Seclin (FR)

( * ) Notice: Subject to any disclaimer, the term of this patent is extended or adjusted under 35 U.S.C. 154(b) by 515 days.

(21) Appl. No.: 16/334,423

(22) PCT Filed: Sep. 26, 2017

(86) PCT No.: PCT/FR2017/052577
§ 371 (c)(1),
(2) Date: Mar. 19, 2019

(87) PCT Pub. No.: WO2018/060581
PCT Pub. Date: Apr. 5, 2018

(65) Prior Publication Data

US 2019/0217355 A1 Jul. 18, 2019

(30) Foreign Application Priority Data

Sep. 27, 2016 (FR) ..... 16 59083

(51) Int. Cl.
*B21B 45/02* (2006.01)
*B08B 1/00* (2006.01)
(Continued)

(52) U.S. Cl.
CPC ..... *B21B 15/0035* (2013.01); *B08B 1/005* (2013.01); *B08B 1/04* (2013.01);
(Continued)

(58) Field of Classification Search
CPC .. B08B 1/02; B08B 1/04; B08B 1/005; B21B 15/0035; B21B 39/006; B21B 45/0278;
(Continued)

(56) References Cited

U.S. PATENT DOCUMENTS 4,551,878 A * 11/1985 Turley ..... B21B 45/0284 100/153
4,763,505 A * 8/1988 Klute ..... B21B 13/145 72/238

(Continued)

FOREIGN PATENT DOCUMENTS

DE 19815029 B4 * 7/2006 ..... B21B 31/10
EP 0 568 418 11/1993

(Continued)

OTHER PUBLICATIONS

International Search Report, PCT/FR2017/052577, dated Nov. 8, 2017.

*Primary Examiner* — Joseph J Hail
*Assistant Examiner* — Jonathan R Zaworski
(74) *Attorney, Agent, or Firm* — Nixon & Vanderhye

(57) ABSTRACT

A treatment device for drying a laminated strip includes: lower and upper crosspieces extending transversely to and on either side of the metal strip, the upper crosspiece embedding an upper pressure cylinder with supporting rollers, the lower crosspiece embedding a lower pressure cylinder with the supporting rollers, the actuator and guide enabling the crosspieces to pass from a retracted idle position to a close working position, for which the lower and upper pressure cylinders, arranged on either side of the strip, transversely to the direction of travel, are each intended to be pressure-applied on the strip by the supporting rollers distributed along the length of the pressure cylinder, and along at least two rotating axes parallel to the longitudinal axis of the pressure cylinder. A first compartment supports all the supporting rollers. A second compartment supports the pressure cylinder. Each compartment is a removable element of the crosspiece.

19 Claims, 6 Drawing Sheets

(51) Int. Cl.

| | |
|---|---|
| ***B08B 1/04*** | (2006.01) |
| ***B21B 15/00*** | (2006.01) |
| ***B21B 1/22*** | (2006.01) |
| *B21B 39/00* | (2006.01) |

(52) U.S. Cl.
CPC ..... *B21B 1/22* (2013.01); *B21B 45/0275* (2013.01); *B21B 45/0278* (2013.01); *B21B 39/006* (2013.01); *B21B 45/0284* (2013.01); *B21B 2203/06* (2013.01)

(58) Field of Classification Search
CPC . B21B 45/0284; B21B 2203/06; B21B 31/08; B21B 31/10; B21B 31/103
USPC ..... 118/500; 269/289 MR; 100/176; 15/102
See application file for complete search history.

(56) References Cited

U.S. PATENT DOCUMENTS

| | | | | | |
|---|---|---|---|---|---|
| 4,782,545 | A * | 11/1988 | Aiassa | H05K 3/26 | 15/77 |
| 4,843,673 | A * | 7/1989 | Sendzimir | B21B 45/0284 | 15/102 |
| 5,335,387 | A * | 8/1994 | Grillat | B21B 45/0284 | 100/160 |
| 5,737,796 | A | 4/1998 | Sendzimir | | |
| 6,041,636 | A * | 3/2000 | Datzuk | B21B 13/145 | 72/238 |
| 6,581,429 | B1 * | 6/2003 | Takakura | B21B 45/0278 | 72/236 |
| 10,226,804 | B2 * | 3/2019 | Ernst de la Graete | B21B 13/145 | |

FOREIGN PATENT DOCUMENTS

| | | | | |
|---|---|---|---|---|
| EP | 1 712 305 | | 10/2006 | |
| FR | 2648372 | A1 * | 12/1990 | B21B 31/02 |
| FR | 2661625 | A1 * | 11/1991 | B21B 31/103 |
| FR | 2 806 941 | | 10/2001 | |
| JP | 63 309317 | | 12/1988 | |
| KR | 101557723 | B1 * | 10/2015 | B21B 31/10 |

* cited by examiner

DEVICE FOR DRYING A METAL STRIP

BACKGROUND OF THE INVENTION

Field of the Invention

The invention relates to a device for drying a metal strip, of easier maintenance.

The field of the invention is that of cold rolling for which it is necessary to spray on the strip to be laminated large volumes of a liquid, consisting of an oil or an emulsion in water, to carry out the lubrication and cooling of the strip and the cylinders. At the rolling mill output, the liquid film covering the strip is removed, in particular to enable satisfactory winding of the strip onto the coiler.

Description of the Related Art

To this end, drying devices comprising two pressure cylinders, substantially parallel, arranged on either side of the strip to be laminated, perpendicular to the direction of travel thereof and which are applied directly onto the strip with a predetermined force so as to remove the oil are known in the prior art. Small-diameter pressure cylinders are typically used, which dry more effectively, but which are more sensitive to bending that larger diameter cylinders.

In the prior art, such drying devices are known from the document EP 0568 418 A1 and from the document EP 1 712 305 A1. Each pressure cylinder is applied onto the strip by means of a plurality of rollers distributed along the length of the cylinder, and following two axes of rotation substantially parallel with the axis of the pressure cylinder.

In these two documents, the rollers are supported by a plurality of bearing blocks, distributed along the length of the cylinder, pneumatic cylinders, respectively associated with the bearing blocks, enabling independent control of the pressures applied on the different roller subassemblies borne by the bearing blocks. Such drying devices according to this prior art further include means for controlling the fluid supply of the pneumatic cylinders, according to the width of the strip and the position thereof between the cylinders: such a drying device design makes it possible advantageously to apply pressure cylinder application forces, only or essentially on the part of the cylinders in contact with the strip: the compressed air intake is actuated solely to the pneumatic cylinders capable of applying the force thereof over the width of the strip to be dried, whereas the cylinders of the bearing blocks next to the parts of the cylinders protruding laterally from the strip are not supplied (or supplied at reduced pressure): this prevents defects such as those mentioned in the document EP 0 568 418 A1, namely rolling of the edges of the metal strip and poor drying of the median part of the metal strip.

In such a drying device, the upper assembly comprising the upper pressure cylinder, the pressure rollers, the bearing blocks thereof, and the corresponding pneumatic cylinders is borne by an upper crosspiece, positioned above the plane of travel of the strip to be dried, whereas the lower assembly comprising the lower pressure cylinder, the pressure rollers, the bearing block thereof and the corresponding pneumatic cylinders is borne by a lower crosspiece, positioned below the plane of travel of said strip to be dried.

As disclosed by the document EP 0 568 418 A1, the upper crosspiece may be connected to the lower crosspiece by means of hydraulic cylinders which make it possible, when retracted, to hold the working cylinders in the working position, in a first crosspiece position (illustrated on the left half of FIG. 2 of this priority document) where the pressure cylinders are close together: the crosspiece positions are determined by abutments set such that the upper cylinder and the lower cylinder do not apply any appreciable pressure onto the strip when the crosspieces are in this first position and the pneumatic cylinders associated with these cylinders are not pressurised. The deployment of the hydraulic cylinders further makes it possible to separate the crosspieces, in a second relative position (illustrated on the right half of FIG. 2) of the lower and upper crosspieces which allows drying cylinder and pressure roller replacement operations, as described hereinafter.

For each crosspiece (respectively upper or lower), the pressure cylinder (respectively upper or lower) and the bearing blocks (including the corresponding pressure rollers) are supported by the same beam. Lugs, substantially parallel, are rigidly connected to both ends of this beam and secure the cylinder by both ends thereof, by means of bearings, respectively provided between the ends of the cylinder and the corresponding lugs. The bearing blocks are distributed along the length of the beam, each bearing block being connected to the beam by means of a rod traversing a bore of the beam. In other words, the assembly comprising the pressure cylinder, the bearing blocks, the pressure rollers thereof and the beam forms a self-supporting assembly, usually referred to as a "cassette" inserted into a longitudinal cavity of the crosspiece having a U-shaped cross-section.

The cylinder bodies are rigidly connected to the crosspiece, on the other side of the crosspiece with respect to the housing for the cassette, bores being drilled in the crosspieces aligned with the bearing block rods. These bores allow the passage of the rods of the pneumatic cylinders, which when pressurised engage with the rods of the bearing blocks to transmit the thrust force (as illustrated in the left half of FIG. 2).

In the absence of thrust of the pneumatic cylinders (as illustrated in the right half of FIG. 2) springs between the rod and the beam constrain the bearing blocks and the rollers thereof towards the beam, the rod of each pneumatic cylinder being kept at a distance from the bearing end of the rod of the bearing block. In this position, and during maintenance, it is possible to remove the cassette, namely the self-supporting assembly (including the pressure cylinder, the bearing blocks and the pressure rollers thereof and the beam) after removing a pin, via an opening at the longitudinal end of the crosspiece, by sliding the supporting beam of the cassette along the crosspiece.

According to the inventor's observations:

- frequently, it is necessary to remove the pressure cylinders in order to grind same (or replace same), while the pressure rollers require no regular maintenance,
- the design of the removable cassette, as disclosed by the priority documents EP 0 568 418 A1 or EP1 712 305 A1 merely makes it possible to remove the cassette and the pressure rollers thereof simultaneously, and could be enhanced, in particular due to the elevated weight of the cassette.

BRIEF SUMMARY OF THE INVENTION

The aim of the present invention is that of proposing a drying device which remedies the drawbacks cited above, of easier maintenance compared to the prior art cited above.

A further aim of the present invention is that of proposing a drying device having a modular design, which can be suitable for various drying conditions.

Further aims and advantages will emerge from the following description which is merely given by way of indication and which is not intended to limit same. In addition, the invention relates to a treatment device intended for drying a laminated strip comprising:

two crosspieces, lower and upper, extending transversely to the metal strip, on either side of the strip, the upper crosspiece carrying an upper pressure cylinder and pressure rollers of said upper pressure cylinder, the lower crosspiece carrying a lower pressure cylinder and pressure rollers of said lower pressure cylinder, actuation means and guiding means enabling the crosspieces to pass from a separated, or so-called idle, position, to a close, or so-called working, position, for which the two pressure cylinders, lower and upper, arranged on either side of the strip, transversely to the direction of travel, are each intended to be applied in pressure on the strip by means of said pressure rollers distributed along the length of the pressure cylinder, and along at least two axes of rotation parallel with the longitudinal axis of said pressure cylinder.

According to the invention, the device comprises for each crosspiece, lower and upper, a first sliding member supporting all of said pressure rollers associated with the lower or upper pressure cylinder, the first sliding member being a removable element of the crosspiece, by sliding said sliding member along the longitudinal axis of the crosspiece, a second sliding member supporting the pressure cylinder, lower or upper, the second sliding member being a removable element of the crosspiece, by sliding said sliding member along the longitudinal axis of the crosspiece, and so as to enable the removal of said pressure cylinder by sliding said second sliding member, while the first sliding member and the corresponding pressure rollers are kept in said crosspiece.

According to one embodiment, each crosspiece has a U-shaped section, including one intermediate wall and two side walls adjacent to the intermediate wall, forming respectively the arms of the U, the inter-gap defined between the intermediate wall and the two side walls forming a cavity for receiving the first sliding member and the second sliding member, in a stacked manner in said cavity, said pressure cylinder being intended to protrude partially from the opening defined between the two free edges of said side walls, and wherein the device comprises, for each crosspiece, lower or upper:

first guiding means between the first sliding member and the side walls of the crosspiece, second guiding means between the second sliding member and the side walls of the crosspiece.

According to one embodiment, the first guiding means comprise:

grooves oriented along the side walls, facing one another, at a depth of the inner surface of the side walls, protruding ribs arranged on either side of the two longitudinal sides of a framework of the first sliding member intended to be inserted respectively into said grooves.

According to one embodiment, the second sliding member comprises said cylinder, as well as chocks rotatably mounted at the ends of said cylinder by means of bearings.

The second guiding means may thus comprise:

sliding surfaces of said chocks, parallel and opposite, on either side of the axis of rotation of said cylinder, engaging with corresponding inner surfaces of said side walls, parallel, so as to allow possible sliding of the chocks, along a limited travel along the height of the side walls, along a perpendicular direction to the plane of travel of the metal strip, shoulders of said side walls, in the vicinity of the free ends oriented along the side walls, on either side of the axis of rotation of said cylinder, said shoulders of the crosspiece and the chocks engaging mutually at the end-of-travel abutment of the chocks, so as to ensure that the second sliding member is held in said cavity of the crosspieces.

According to one advantageous embodiment, the device may comprise for each crosspiece, lower or upper:

the pressure rollers supported by a plurality of bearing blocks, distributed along the length of said pressure cylinder, independent actuators such as pneumatic cylinders borne by the crosspiece distributed along the crosspiece and engage with said bearing blocks, so as to enable the setting of the application forces of the pressure cylinders only or essentially along the section of length of the cylinders in contact with the metal strip.

According to one embodiment, the framework of the first sliding member includes a frame formed from two longitudinal beams and two transversal beams, which when inserted into the crosspiece is of fixed position with respect to the crosspiece, said bearing blocks being received at least partially in the inner volume of the frame, each bearing block being mounted free along a limited travel with respect to the framework, along the direction of the clamping plane, perpendicular to the plane of the framework frame.

According to one embodiment, said actuators comprise fastening ends, in particular having a T-shaped cross-section, intended to be inserted into complementary grooves of the bearing blocks, oriented along the axis of the crosspiece the fastening ends and the fastening grooves being configured to enable the coupling of the actuators with the respective bearing blocks thereof upon the insertion movement of said first sliding member in the crosspiece.

According to one embodiment, the device comprises a third sliding member supporting at least one scraper intended to scrape the strip, suitable for replacing for each crosspiece the second sliding member, engaging with the pressure rollers such that each of the scrapers may be applied in pressure on the strip by means of said pressure rollers.

According to one embodiment, the third sliding member comprises a beam having sliding surfaces, parallel and opposite, engaging with corresponding inner surfaces of said side walls, parallel, so as to allow possible sliding of the third sliding member, along a limited travel along the height of the side walls, along a perpendicular direction to the plane of travel of the metal strip.

According to one embodiment, the device comprises a fourth sliding member comprising a roller with a textile surface coating and chocks rotatably mounted at the ends of the roller, intended to replace, for each crosspiece, simultaneously said first sliding member and said second sliding member.

According to one advantageous embodiment, the upper crosspiece and the lower crosspiece having at the longitudinal ends thereof abutments, in the form of projections, directed towards one another, distributed laterally on either side of the strip to be dried, which in said working position of the pressure cylinders, or working position of the scrapers, engage mutually against one another, defining a slot of defined thickness for the passage of the strip to be dried between the upper crosspiece and the lower crosspiece.

The wings of the side walls of the crosspieces, upstream along the direction of travel of the strip to be dried, then advantageously form the first physical obstacles for the oil, prior to the action of the pressure cylinders (or scrapers), during drying.

BRIEF DESCRIPTION OF THE DRAWINGS

The invention will be understood more clearly on reading the following description accompanied by the appended figures wherein.

DETAILED DESCRIPTION OF THE PREFERRED EMBODIMENTS

Figure 1:
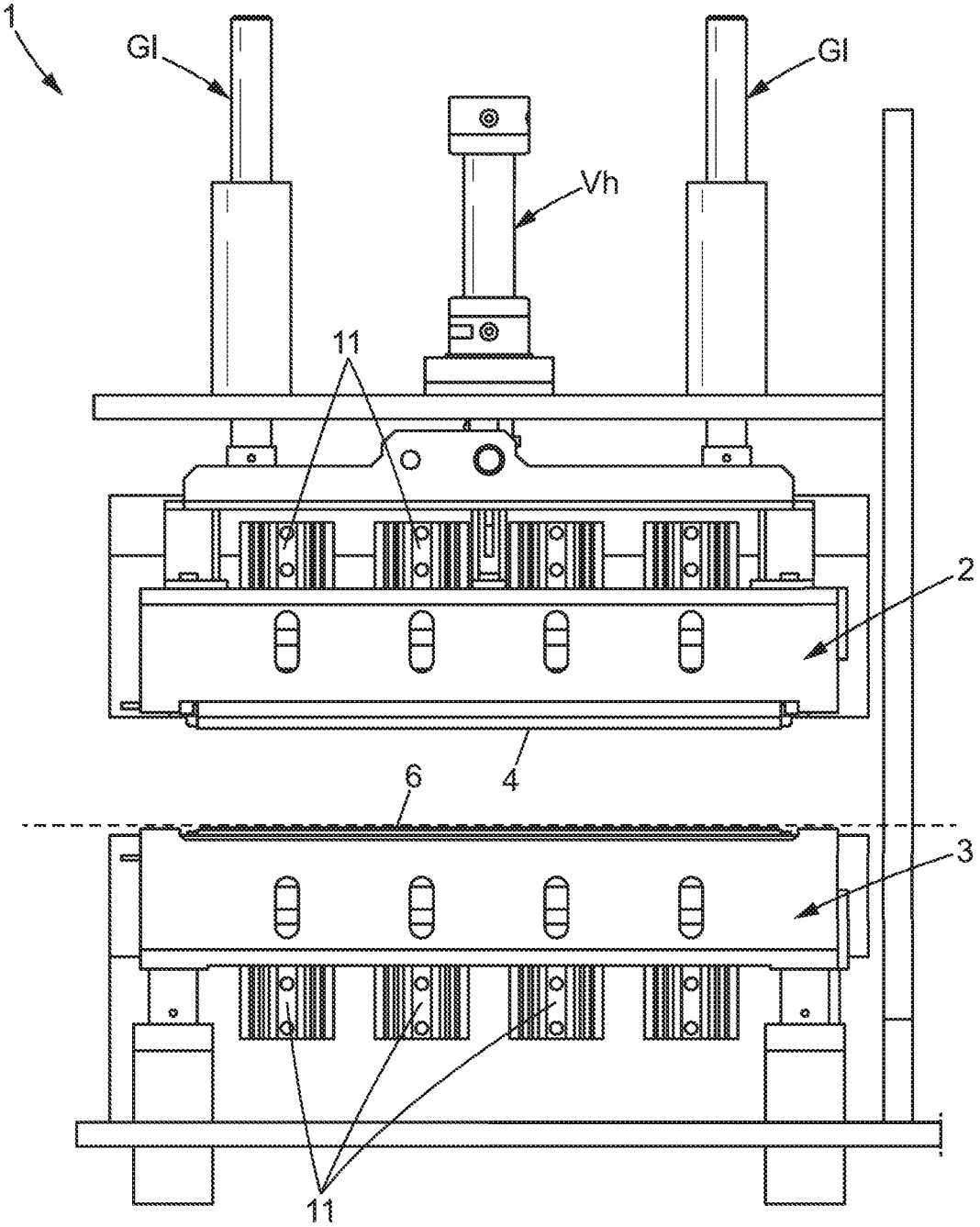
FIG. 1 is a front view of a drying device, in the idle position of said device for which the upper and lower crosspieces are separated.

The invention relates to a treatment device 1 intended for drying a laminated strip B comprising:

- two crosspieces 2, 3, respectively lower and upper, extending transversely to the metal strip, on either side of the strip, the upper crosspiece 2 carrying an upper pressure cylinder 4 and pressure rollers 5 of said upper pressure cylinder, the lower crosspiece 3 carrying a lower pressure cylinder 6 and pressure rollers 7 of said lower pressure cylinder,
- actuation means Vh and guiding means G1 enabling the crosspieces 2, 3 to pass from a separated, or so-called idle, position P1, to a close, or so-called working, position P2, for which the two pressure cylinders 4, 6, lower and upper, arranged on either side of the strip, transversely to the direction of travel, are each intended to be applied in pressure on the strip by means of said pressure rollers 5, 7 distributed along the length of the pressure cylinder, and along at least two axes of rotation A4; A7 parallel with the longitudinal axis of said pressure cylinder.

As illustrated by way of indication in FIG. 1, the actuation means Vh may comprise a hydraulic cylinder. This hydraulic cylinder may for example move the upper crosspiece 2, while the lower crosspiece rests at the ends thereof on abutments. This hydraulic cylinder therefore connects an upper part of the frame to the crosspiece. Guides make it possible to follow the upper crosspiece 2 when moved by this hydraulic cylinder, along a direction of movement parallel with the plane of the cylinders. Optionally, the lower crosspiece may also be moved by another, lower, hydraulic cylinder.

However, the invention relates to the maintenance of such a drying device.

According to the invention, the device 1 comprises for each crosspiece 2; 3, lower and upper:

- a first sliding member 50; 70 supporting all of said pressure rollers 5; 7 associated with the lower or upper pressure cylinder, the first sliding member 50; 70 being a removable element of the crosspiece 2; 3, by sliding said sliding member along the longitudinal axis of the crosspiece,
- a second sliding member 40; 60 supports the pressure cylinder 4; 6, lower or upper, the second sliding member being a removable element of the crosspiece, by sliding said sliding member along the longitudinal axis of the crosspiece.

Such a design enables the removal of said pressure cylinder 4; 6 by sliding said second sliding member 40; 60, while the first sliding member 50; 70 and the corresponding pressure rollers 5; 7 are kept (retained) in said crosspiece 2; 3. These operations are facilitated due to the controlled weight of these sliding members 40, 60 which only support one of the pressure cylinders, and not the assembly comprising this cylinder and the pressure rollers thereof.

Advantageously when only the pressure cylinders require a replacement, it is possible to:

- remove the pressure cylinders 4 or 6 while retaining the pressure rollers 5 or 7 in the crosspieces 2 or 3 of the drying device,
- insert the new pressure cylinders, by inserting second sliding members 40; 60 into the upper and lower crosspieces, and while the first sliding members 50; 70 and the pressure rollers thereof are still present.

According to one embodiment, each crosspiece 2; 3 may have a U-shaped section, including one intermediate wall 20; 30 and two side walls 21, 22; 31; 32 adjacent to the intermediate wall, forming respectively the arms of the U. The inter-gap defined between the intermediate wall 20; 30 and the two side walls 21, 22; 31, 32 forms a cavity for receiving the first sliding member 50; 70 and the second sliding member 40; 60 in a stacked manner in this cavity.

The first sliding member 50, 70 and the second sliding member 40, 60 are stacked in the cavity, the first sliding member positioned to the rear of the cavity, the second sliding member, positioned in the vicinity of the opening defined between the two free edges of said side walls and such that said pressure cylinder protrudes partially from this opening during drying.

The device may thus comprise, for each crosspiece 2; 3, lower or upper:

- first guiding means between the first sliding member 50; 70 and the side walls 21, 22; 31, 32 of the crosspiece,
- second guiding means between the second sliding member 40; 60 and the side walls 21, 22; 31, 32 of the crosspiece.

According to one advantageous embodiment, for each crosspiece 2; 3, lower upper:

the pressure rollers 5, 7 supported by a plurality of bearing blocks 10, distributed along the length of said pressure cylinder, independent actuators 11 such as pneumatic cylinders are borne by the crosspiece 2; 3 distributed along the crosspiece and engage with said bearing blocks.

Advantageously, such a design enables the setting of the application forces of the pressure cylinders 4; 6 only or essentially along the section of length of the cylinders in contact with the metal strip B. The compressed air intake is actuated solely to the pneumatic cylinders capable of applying the force thereof over the width of the strip to be dried, whereas the cylinders of the bearing blocks next to the parts of the cylinders protruding laterally from the strip are not supplied (or supplied at reduced pressure): this prevents defects such as those mentioned in the document EP 0 568 418 A1, namely rolling of the edges of the metal strip and poor drying of the median part of the metal strip.

For each crosspiece, lower or upper, the cylinder body may be rigidly connected to the crosspiece, fastened to the intermediate wing 20 or 30, external to the crosspiece, the rods of the pistons traversing bores of the intermediate wing 20 or 30, and so as to engage with the bearing blocks of the first sliding members received in the cavity of the crosspiece.

According to one embodiment, said actuators 11 (in particular the piston rods) may comprise fastening ends 12, in particular having a T-shaped cross-section, intended to be inserted into complementary grooves of the bearing blocks 10, oriented along the axis of the crosspiece 2; 3 the fastening ends and the fastening grooves being configured to enable the coupling of the actuators with the respective bearing blocks 10 thereof upon the insertion movement of said first sliding member 50; 70 in the crosspiece 2; 3. Conversely, such a design enables the uncoupling of the actuators with the bearing block 10 thereof upon the removal movement of said first sliding member 50; 70 out of the crosspiece.

According to one advantageous embodiment, coupling or uncoupling will only be possible in the retracted position of the actuators 11, the coupling end then aligned (along the axis of the cylinder) with a notch 13 of the framework enabling the extension thereof. On the other hand and when the actuator 11 is in the non-retracted position, the framework of the first sliding member 50; 70 forms a physical abutment blocking the extension of the first sliding member along the sliding axis.

According to one embodiment, the framework of the first sliding member 50, 70 includes a self-supporting frame formed from two longitudinal beams L and two transversal beams T. When inserted into the corresponding crosspiece 2 or 3, this framework is of fixed position with respect to the crosspiece 2. The bearing blocks 10 are then received at least partially in the inner volume of the frame, each bearing block 10 being mounted free along a limited travel with respect to the framework, along the direction of the clamping plane, perpendicular to the plane of the framework frame. The framework and the bearing blocks 10 (and the rollers 5 or 7 thereof) of the first sliding member 50 or 70 form a self-supporting assembly which may be removed or inserted in one piece in the crosspiece. The notch 13 mentioned above may be created on one of the transversal beams.

The first guiding means between the first sliding member and the crosspiece may thus comprise:

grooves R oriented along the side walls 21, 22; 31, 32, facing one another, at a depth of the inner surface of the side walls, protruding ribs N arranged on either side of the two longitudinal sides of a framework of the first sliding member 50, 70 intended to be inserted respectively into said grooves.

Figure 5:
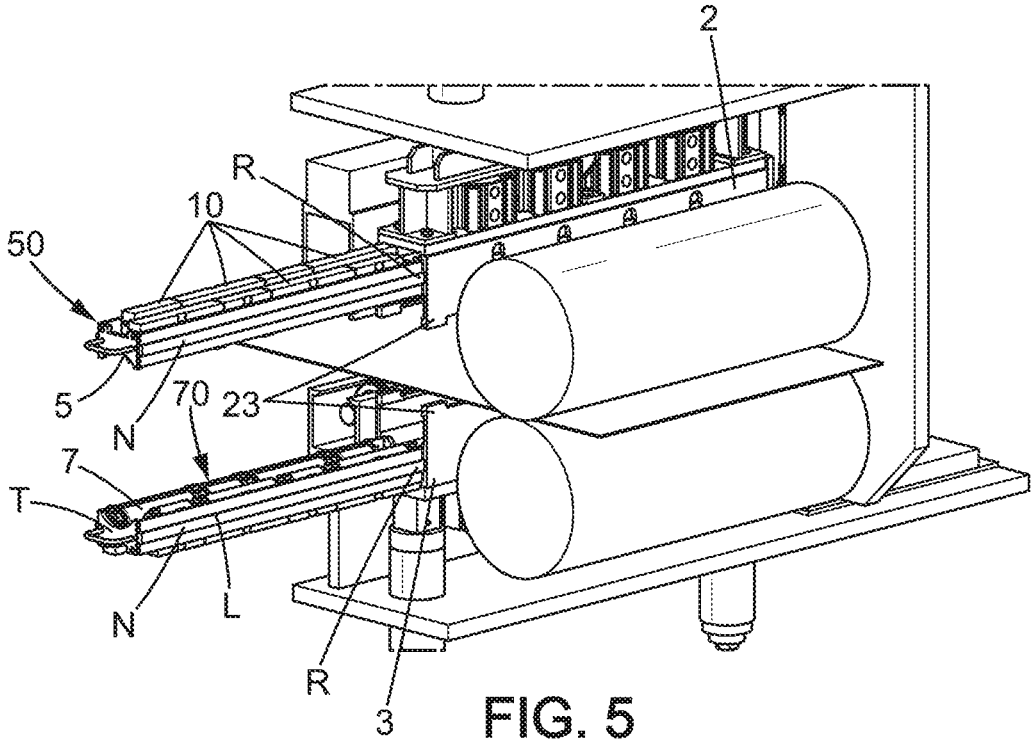
FIG. 5 is a consecutive view of FIG. 3 (or of FIG. 4) illustrating the removal of said pressure rollers by sliding the first sliding members.
Figure 6:
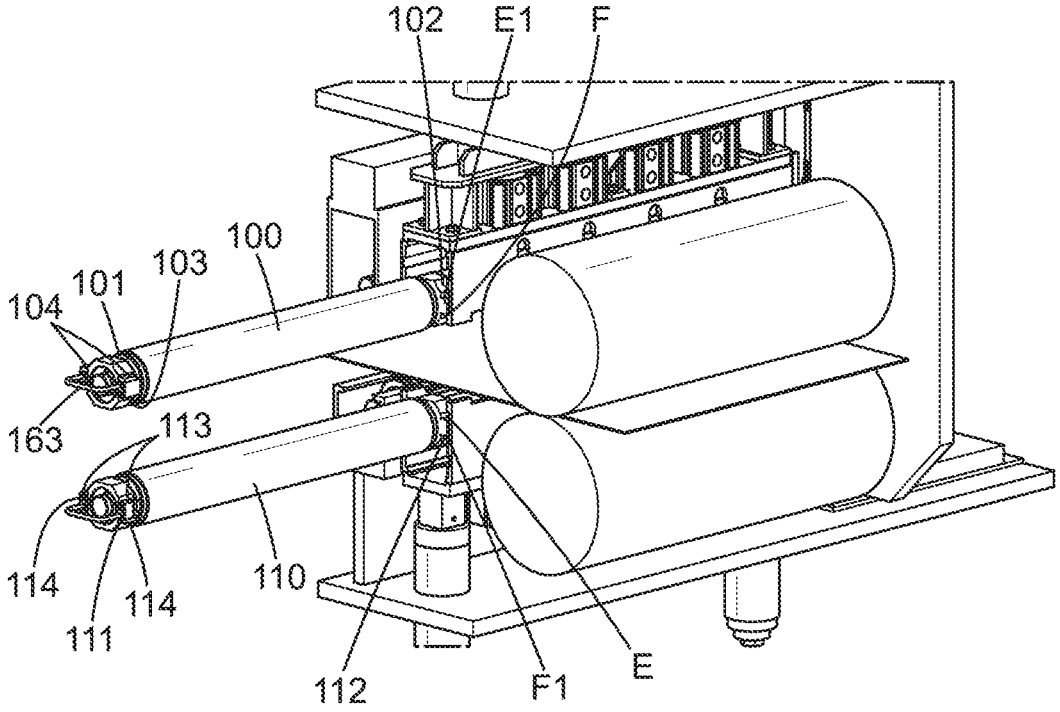
FIG. 6 is a view of the removal of the textile rollers by sliding the fourth sliding members.
Figure 7:
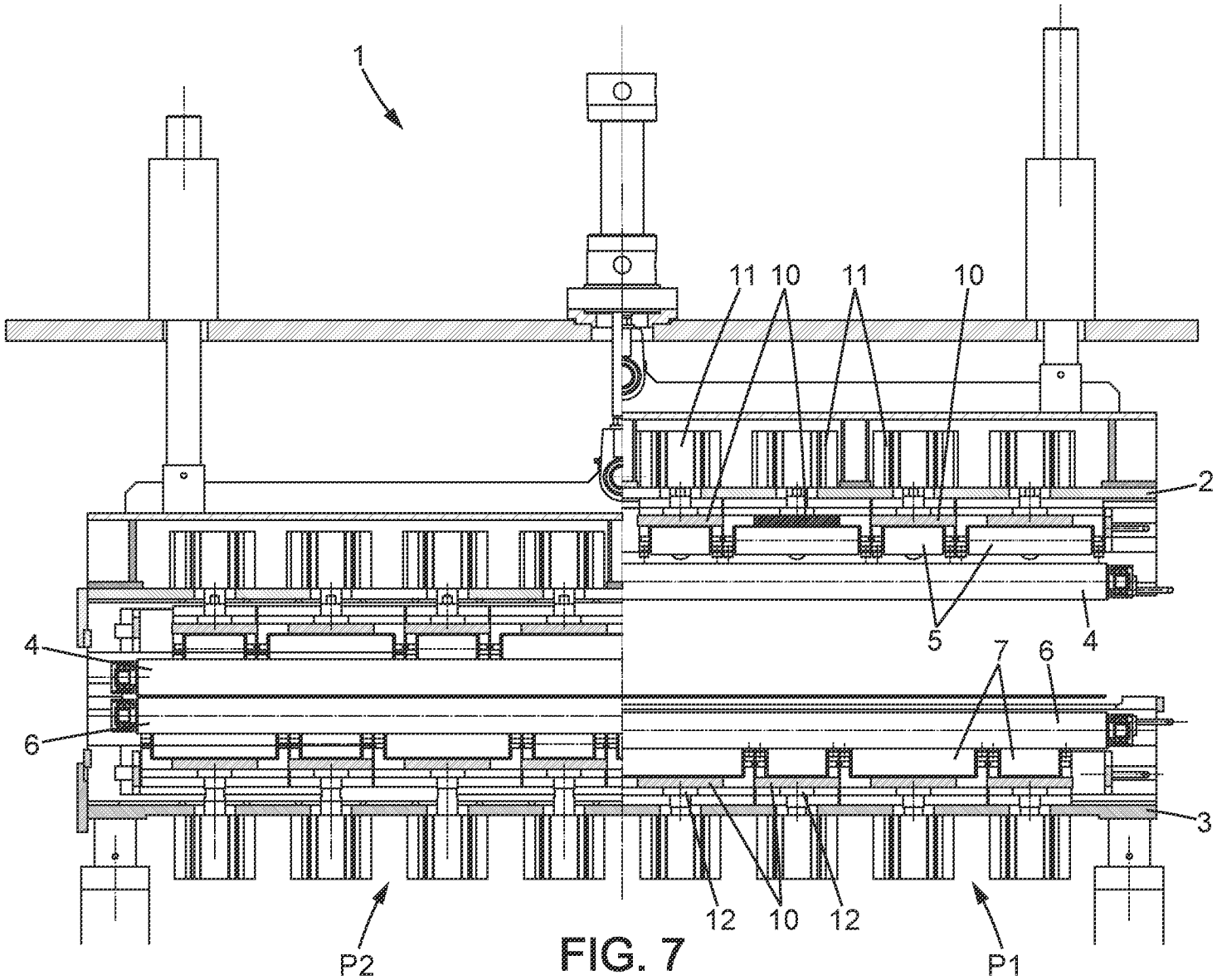
FIG. 7 is a sectional view of the drying device, along a cutting plane via the axes of the pressure cylinders, the left half of the rolling mill being in a working position for which the crosspieces are close together, the right half in an idle position for which the crosspieces are separated.

According to the non-limiting example in FIG. 5, it is observed that the ribs N are parallel with the longitudinal beams of the framework of the first sliding member 50, 70, protruding on either side of the framework. These ribs N are inserted to within the insertion clearance into the two practical corresponding grooves N at a depth of the inner surfaces of the side walls.

Once the ribs have been inserted into the grooves, the engagement locks the position of the sliding member at the rear of the cavity, i.e. in the vicinity of the intermediate wing 20 or 30 of the crosspiece, and so as to leave the rest of the cavity free: this ensures the presence of a clearance in the cavity allowing the insertion of the second sliding member bearing the pressure cylinders 4, 6, or the insertion of a third sliding member bearing scrapers, and which will be described hereinafter.

According to one embodiment, the second sliding member 40; 60 comprises said cylinder 4; 6, as well as chocks 41, 42; 61, 62 rotatably mounted at the ends of said cylinder 4; 6 by means of bearings. The two chocks 41, 42; 61, 62 and the pressure cylinder 4; 6 form a self-supporting assembly which may be removed, or inserted in one piece during replacement operations.

According to one embodiment, the second guiding means comprise:

sliding surfaces of said chocks 41, 42; 61, 62, parallel and opposite, on either side of the axis of rotation of said cylinder 4; 6, engaging with corresponding inner surfaces of said side walls, parallel, so as to allow possible sliding of the chocks 41, 42; 61, 62, along a limited travel along the height of the side walls 21, 22; 31, 32, along a perpendicular direction to the plane of travel of the metal strip, shoulders E of said side walls, in the vicinity of the free ends oriented along the side walls 21, 22; 31, 32, engaging with corresponding shoulders of said chocks 41, 42; 61, 62, on either side of the axis of rotation of said cylinder, said shoulders of the crosspiece 2; 3 and the chocks 21, 22; 31, 32 engaging mutually at the end-of-travel abutment of the chocks, so as to ensure that the second sliding member 40; 60 is held in said cavity of the crosspieces.

These guiding means thus allow in operation a relative movement between the pressure cylinder 4; 6 and the crosspiece 2; 3 along a parallel direction with the clamping plane, by sliding the chocks along the side walls, particularly when the pressure cylinder engages in rolling with the pressure rollers of the bearing blocks 10.

The shoulders E of the crosspiece and those corresponding to the chocks 21, 22; 31, 32 have the function of ensuring that the second sliding member 40, 60 is held in the crosspiece, in particular for the second sliding member 40; 60 present in the upper crosspiece 2, which in the idle position will be forced downwards under the action of gravity.

According to one advantageous embodiment, the device may comprise a third sliding member 80; 90 supporting at least one scraper 8; 9 intended to scrape the strip, suitable for replacing for each crosspiece 2; 3 the second sliding member 40; 60.

Advantageously, this third sliding member engaging with the pressure rollers 5, 7 such that each of the scrapers 8, 9 may be applied in pressure on the strip B by means of said pressure rollers: in this case, the drying device is provided with the actuators 11; this enables the setting of the application forces of the scrapers 8; 9 only or essentially along the section of length of the cylinders in contact with the metal strip B. The compressed air intake is actuated solely to the pneumatic cylinders capable of applying the force thereof over the width of the strip to be dried, whereas the cylinders of the bearing blocks next to the parts of the cylinders protruding laterally from the strip are not supplied (or supplied at reduced pressure).

The third sliding member may comprise a beam comprising one or a plurality of scrapers 8; 9 on one of these faces. The scrapers 8, 9 are directed along the length of the beam. When the beam bears a plurality of scrapers, these are situated at a single level so as to scrape the metal strip simultaneously. The scraper(s) are fastened statically on the beam.

Laterally, this beam may have parallel and opposite sliding surfaces 81, 82; 91, 92, engaging with said corresponding inner surfaces of said side walls 21, 22; 31, 32, parallel, so as to allow possible sliding of the third sliding member 80; 90, along a limited travel along the height of the side walls, along a perpendicular direction to the plane of travel of the metal strip.

These beams may further include shoulders 83; 93 engaging with the shoulders E of said side walls, in the vicinity of the free ends oriented along the side walls 21, 22; 31, 32. Said shoulders E of the crosspiece 2; 3 and those 83; 93 of the third sliding members engage mutually at the end-of-travel abutment, so as to ensure that the third sliding member 80; 90 is held in said cavity of the crosspieces 2; 3.

On the back wall (opposite the wall of the beam supporting the scraper(s)), the beam may have a protruding section 84, 94 wherein the curved or (dihedral) profile serves as a support, simultaneously for the pressure rollers borne along the two parallel axes.

According to one embodiment, the device may comprise a fourth sliding member 100; 110 comprising a roller with a textile lining and chocks 101, 102; 111, 112 rotatably mounted at the ends of the roller, intended to replace, for each crosspiece 2; 3, simultaneously said first sliding member and said second sliding member. For each sliding member 100; 110, the textile roller and the chocks thereof form a self-supporting assembly which may be removed or inserted in one piece in the crosspiece.

These chocks 101, 102; 111, 112 may have:

first shoulders 113 engaging with the shoulders E of said side walls, in the vicinity of the free edges oriented along the side walls 21, 22; 31, 32 and so as to block the extension of the chocks, and second shoulders 114 intended to engage with intermediate shoulders E1 to transmit the application force transmitted by the actuation means Vh.

Thus, and even when the device has actuators 11 particularly pneumatic suitable for carrying out a setting of the cylinder application distribution on the width of the strip, these are not used for textile rollers, of larger diameter, frequently subject to a clamping force of lower intensity than that of the pressure cylinders.

Figure 2:
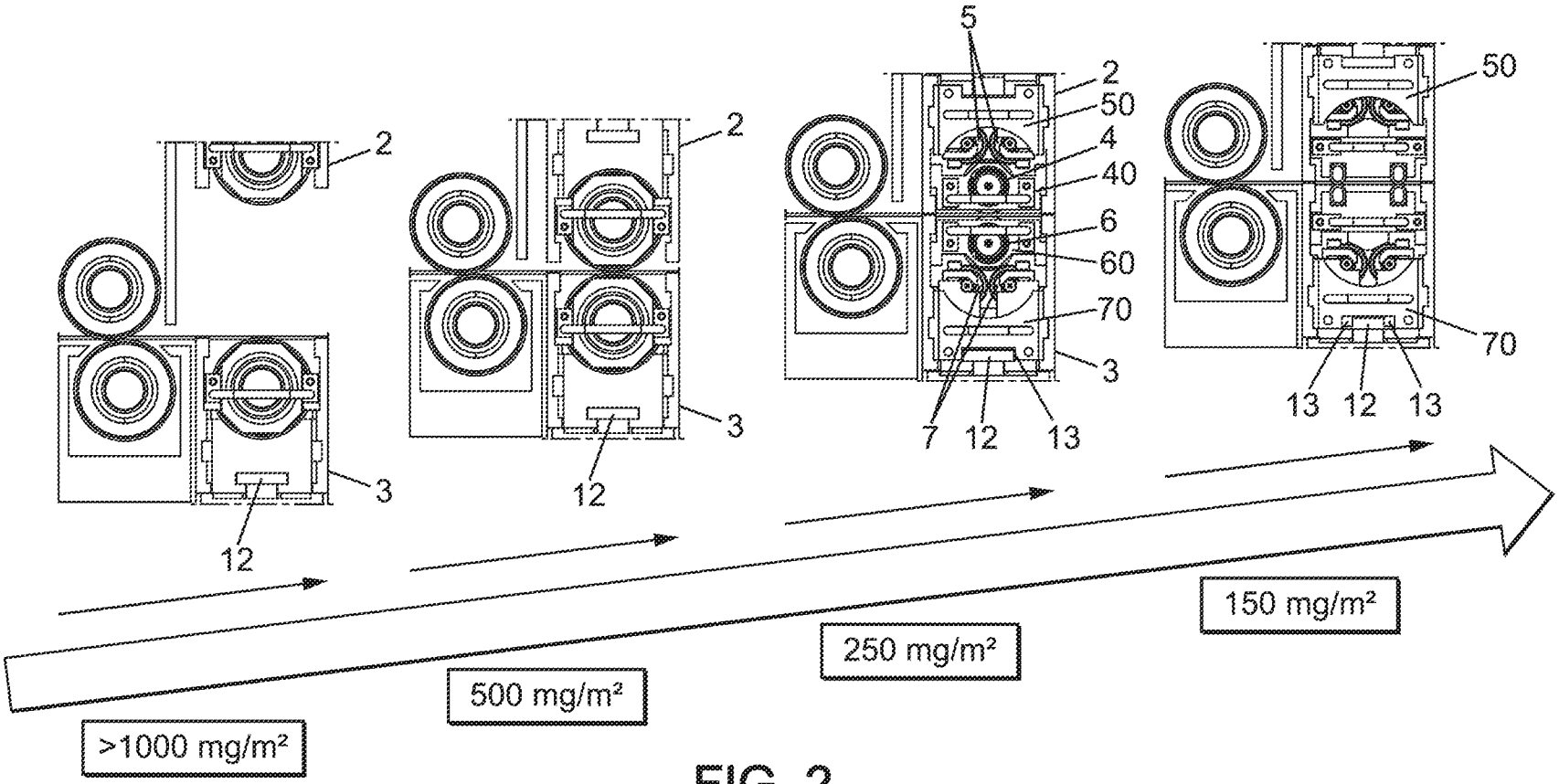
FIG. 2 is a schematic view of different drying options allowed by the modular design of the device, according to the rolling conditions, and for example, from left to right, drying with textile rollers, drying with pressure cylinders (metallic), and drying with elastomer scrapers.
Figure 3:
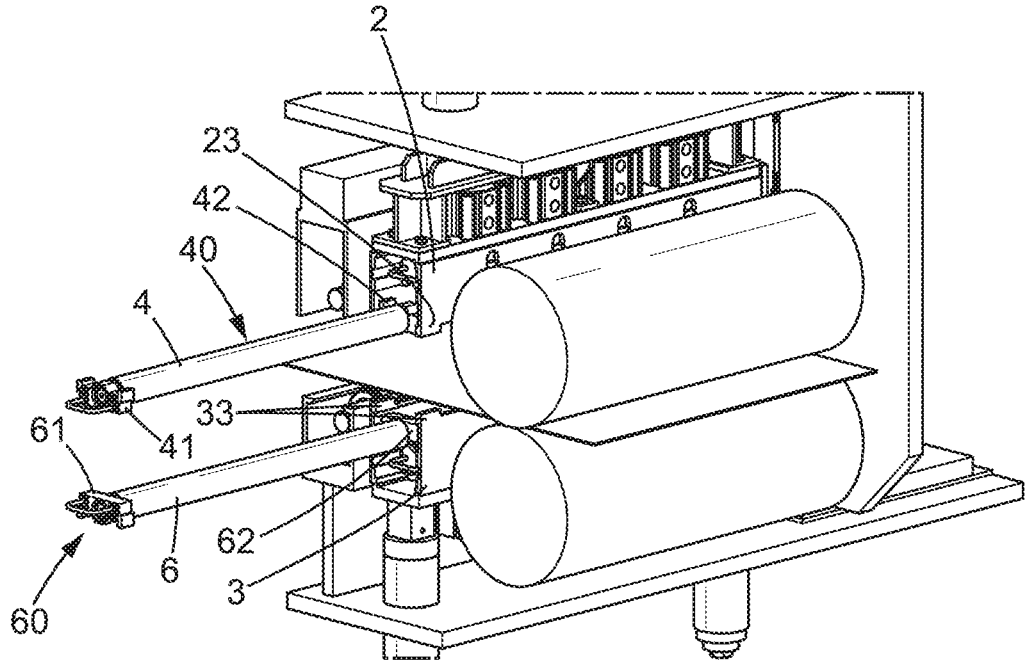
FIG. 3 is a perspective view of the removal of the pressure cylinders by sliding the first sliding members, while the first sliding members, including the pressure rollers are held in position in the crosspiece thereof.
Figure 4:
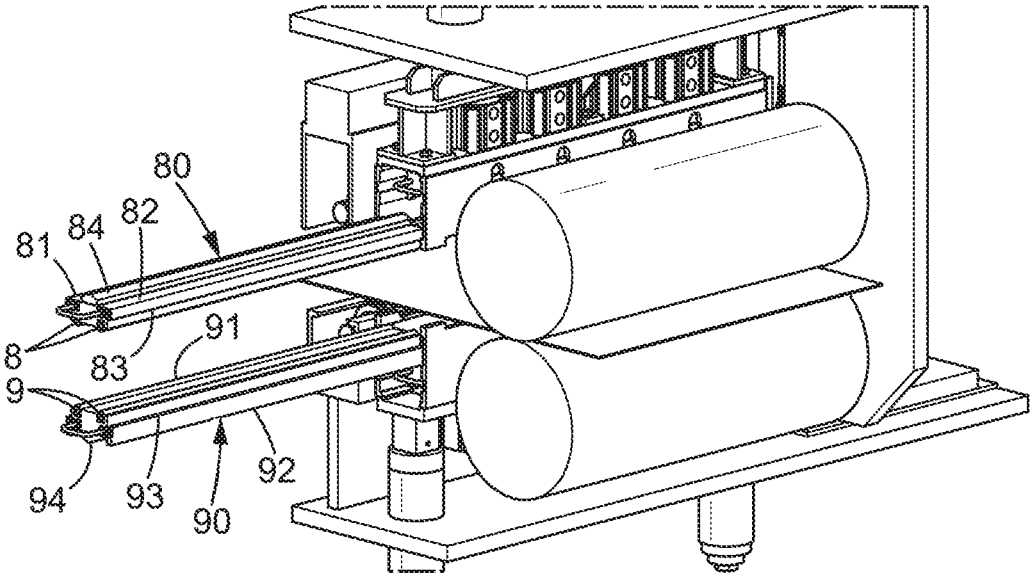
FIG. 4 is a perspective view of the removal of the pressure scrapers by sliding the third sliding members, while the third sliding members, including the pressure rollers are held in position in the crosspiece thereof.

Advantageously, such a modular design of the device, namely the option to use, as drying means, not only pressure cylinders, but also scrapers and/or textile rollers, makes it possible to adapt the drying means according to the drying conditions. As illustrated by way of indication in the graphic in FIG. 2, it is possible to change the drying means according to the quantity of fluid present on the strip to be dried, and quickly, which is enabled by the invention.

According to one advantageous embodiment, the upper crosspiece 2 and the lower crosspiece 3 may have at the longitudinal ends thereof abutments 23, 33, in the form of projections, directed towards one another, distributed laterally on either side of the strip to be dried.

As illustrated in the figures, these abutments 23, 33, typically four in number may be provided, at each arm of the U. In said working position P2 of the pressure cylinders 4, 6, (or working position of the scrapers 8, 9), engage mutually against one another, defining a slot of defined thickness for the passage of the strip to be dried between the upper crosspiece 2 and the lower crosspiece 3.

Figure 8:
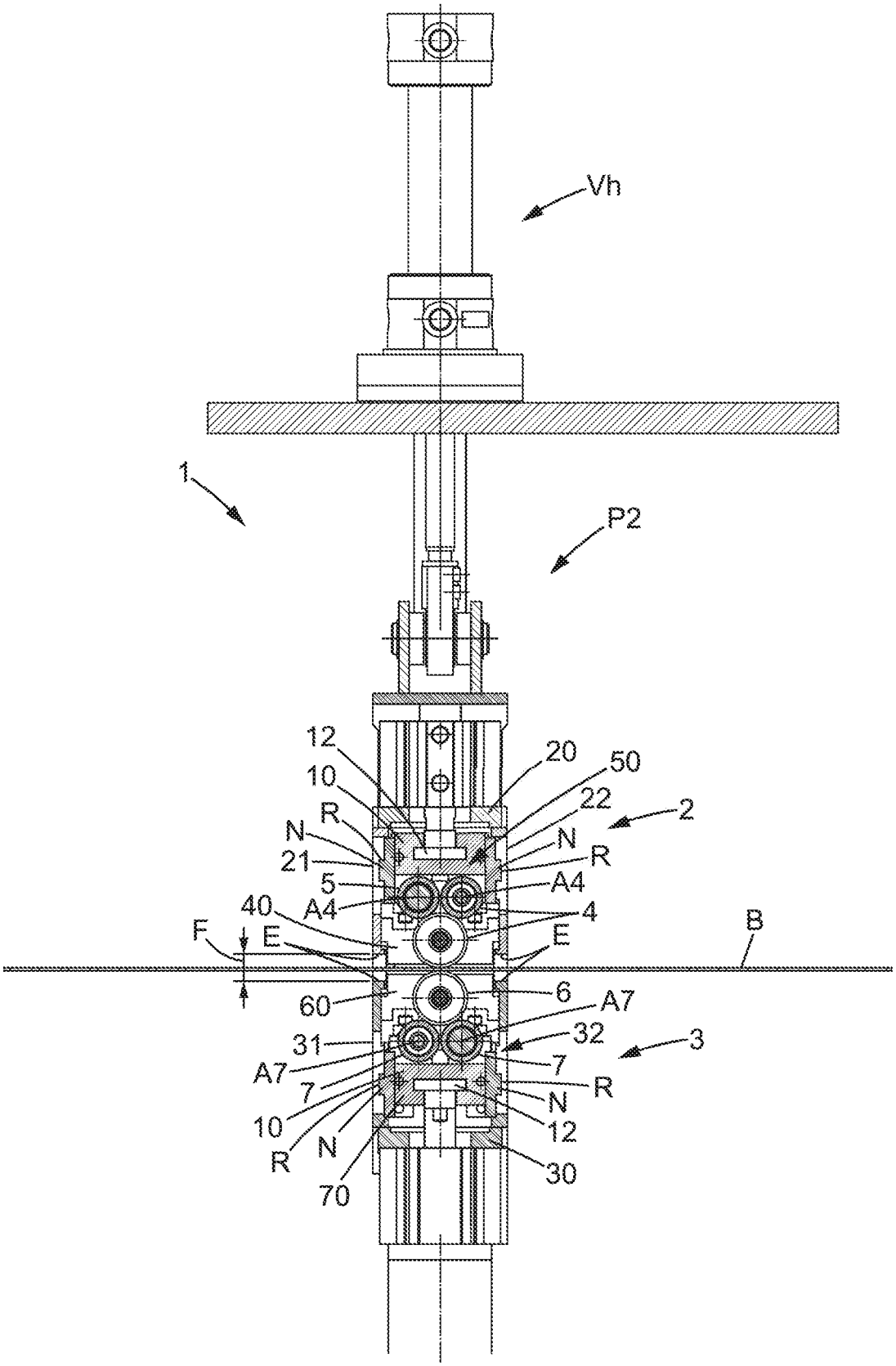
FIG. 8 is a sectional view of the drying device along a perpendicular plane to the axes of the pressure cylinders, in said working position of said device which illustrates the slot created by the lower and upper crosspieces then mutually pressing by the abutments thereof.

Such a slot of thickness "F" is illustrated in FIG. 8 when the upper crosspiece 2 is in contact with the lower crosspiece 3 by means of the abutments 23 and 33 under the action of the actuation means Vh. This slot of small thickness may be defined as less than a few centimetres, for example, less than or equal to 5 cm, particularly less than or equal to 3 cm. In such a case, the side wings of the crosspieces (lower and upper) located upstream (along the direction of travel of the strip) with respect to the pressure cylinders 4 and 6 represent first physical members acting as an obstacle to the oil during drying, and prior to the action of the pressure cylinders. In such a case, the application forces of the pressure cylinders 4 and 6 on the strip to be dried are regulated using regulation on the actuators 11 of the pneumatic type.

The lower and upper crosspieces may also be placed in contact by these abutments 23 and 33 when equipped with the third sliding members bearing the scrapers 8 and 9. In such a case, and in the manner of the pressure cylinders, the application forces of the scrapers 8 and 9 on the strip to be dried are regulated using regulation on the actuators 11 of the pneumatic type.

On the other hand, when equipped with the fourth sliding members bearing the textile rollers, the upper and lower crosspieces are not abutted against one another, but on the contrary in a slightly separated working position: the application forces of the textile rollers on the strip to be dried are then regulated using regulation on the typically hydraulic actuation means. In other words and in this case, the actuators 11 of the pneumatic type are not used.

LIST OF REFERENCE NUMBERS

1. Treatment device,

2. 3. Crosspieces, respectively upper and lower,

4, 6. Pressure cylinder, respectively upper and lower,

5, 7. Pressure rollers (respectively associated with the upper cylinder and the lower cylinder),

8. 9. Scrapers, respectively upper and lower,

10. Bearing blocks,

11. Actuators (pneumatic cylinders) for setting the application forces along the length of the pressure cylinder, or along the length of the scrapers,

20, 21, 22. Intermediate wall, and side walls of the U-shaped section of the upper crosspiece,

30, 31, 32. Intermediate wall, and side walls of the U-shaped section of the lower crosspiece,

23, 33. Mutually engaging protruding abutments belonging respectively to the upper and lower crosspieces,

50, 70. First sliding member (pressure roller supporting member) respectively associated with the upper and lower crosspiece,

40, 60. Second sliding member (cylinder supporting member) respectively associated with the upper and lower crosspiece,

41, 42. Chocks at both ends of the cylinder 4,

61, 62. Chocks at both ends of the cylinder 6,

80, 90. Third sliding member (scraper supporting member),

81, 82; 91, 92. Sliding surface (third sliding member),

83; 93. Shoulder (third sliding member),

84; 84. Roller support section (third sliding member),

100, 110. Fourth sliding member (textile-lined roller supporting member),

101, 102; 111, 112. Textile-lined roller chocks,

B. Metal strip,

E. Shoulder (crosspieces) with abutment function,

G1. Guiding means (Crosspiece(s) with respect to frame),

Vh. Actuation means (Crosspiece),

N. Ribs,

R. Grooves,

T. Transversal beam (first sliding member framework),

L. Longitudinal beam (first sliding member framework).

The invention claimed is:

1. A treatment device for drying a laminated strip, the treatment device comprising:

a lower crosspiece and an upper crosspiece, the upper and lower crosspieces extending transversely to the laminated strip, on either of a top side and a bottom side of the laminated strip, the upper crosspiece carrying an upper pressure cylinder and pressure rollers of said upper pressure cylinder, the lower crosspiece carrying a lower pressure cylinder and pressure rollers of said lower pressure cylinder;

the upper crosspiece comprising a first sliding member supporting all of the pressure rollers associated with the upper pressure cylinder, the first sliding member of the upper crosspiece being removable from the upper crosspiece by sliding the first sliding member of the upper crosspiece along a longitudinal axis of the upper crosspiece, and a second sliding member supporting the upper pressure cylinder, the second sliding member of the upper crosspiece being removable from the upper crosspiece by sliding the second sliding member of the upper crosspiece along the longitudinal axis of the upper crosspiece to enable removal of said upper pressure cylinder by sliding said second sliding member of the upper crosspiece, while the first sliding member of the upper crosspiece and the upper pressure rollers are kept in said upper crosspiece, the lower crosspiece comprising a first sliding member supporting all of the pressure rollers associated with the lower pressure cylinder, the first sliding member of the lower crosspiece being removable from the lower crosspiece by sliding the first sliding member of the lower crosspiece along a longitudinal axis of the lower crosspiece, and a second sliding member supporting the lower pressure cylinder, the second sliding member of the lower crosspiece being removable from the lower crosspiece by sliding the second sliding member of the lower crosspiece along the longitudinal axis of the lower crosspiece to enable the removal of the lower pressure cylinder by sliding the second sliding member of the lower crosspiece, while the first sliding member of the lower crosspiece and the lower pressure rollers are kept in the lower crosspiece; and an actuator and crosspiece guides enabling the crosspieces to pass from a separated idle position to a close working position, for which the upper and lower pressure cylinders that are disposed on either side of the laminated strip, transversely to a direction of travel, are each configured to be applied in pressure on the laminated strip by said respective upper and lower pressure rollers of the respective upper and lower pressure cylinders distributed along a length of the respective pressure cylinders, and along at least two axes of rotation parallel with the longitudinal axis of said respective pressure cylinders.

2. The treatment device according to claim 1, wherein each of the upper and lower crosspieces has a U-shaped section that includes one intermediate wall and two side walls adjacent to the intermediate wall, respectively forming arms of the U-shaped section, an inter-gap defined between the intermediate wall and the two side walls forming a cavity to receive the first sliding member and the second sliding member in a stacked manner in said cavity, said respective upper and lower pressure cylinders of the respective upper and lower pressure crosspieces being configured to protrude partially from an opening defined between two free edges of said side walls, and wherein each of the upper and lower crosspieces further comprises:

a first guide system between the first sliding member and the side walls of the respective crosspiece, and a second guide system between the second sliding member and the side walls of the respective crosspiece.

3. The treatment device according to claim 2, wherein the first guide system comprises:

a plurality of grooves oriented along the side walls, facing one another, at a depth of the inner surface of the side walls, and a plurality of protruding ribs arranged on either side of the two longitudinal sides of a framework of the first sliding member, the protruding ribs being configured to be inserted respectively into said grooves.

4. The treatment device according to claim 2, wherein the second sliding member of each of the respective upper and lower crosspieces comprises said respective cylinder and chocks rotatably mounted at ends of said respective upper and lower cylinders by bearings, and wherein the second guide system comprises:

sliding surfaces of said chocks, parallel and opposite, on either side of the axis of rotation of said respective cylinder, engaging with corresponding inner surfaces of said side walls, parallel, to allow sliding of the chocks along the height of the side walls, along a perpendicular direction to a plane of travel of the laminated strip, and shoulders of said side walls, proximate to the ends oriented along the side walls, engaging with corresponding shoulders of said chocks, on either side of the axis of rotation of said cylinder, said shoulders of the respective upper and lower crosspieces and the chocks engaging mutually at end-of-travel abutment of the chocks, to ensure that the second sliding member is held in said cavity of the respective upper and lower crosspieces.

5. The treatment device according to claim 1, wherein, for each of the upper and lower crosspieces:

the respective pressure rollers are supported by a plurality of bearing blocks, distributed along the length of said respective pressure cylinders, and independent actuators are borne by the respective upper and lower crosspieces, distributed along the respective upper and lower crosspieces, and engage with said respective bearing blocks, thereby enabling setting of application forces of the respective pressure cylinders only or essentially along a section of length of the respective pressure cylinders in contact with the laminated strip.

6. The treatment device according to claim 5, wherein the first sliding member for each of the upper and lower crosspieces includes a self-supporting frame formed from two longitudinal beams and two transversal beams, the self-supporting frame being in a fixed position with respect to the respective upper and lower crosspieces when the self-supporting frame is inserted into the respective upper and lower crosspieces, said bearing blocks being received at least partially in an inner volume of the self-supporting frame, each of the bearing blocks being mounted free along the direction of a clamping plane, perpendicular to a plane of the framework frame.

7. The treatment device according to claim 5, wherein said respective independent actuators comprise a plurality of fastening ends having a T-shaped cross-section, the fastening ends configured to be inserted into complementary grooves of the respective bearing blocks, oriented along an axis of the respective upper and lower crosspieces, the fastening ends and the fastening grooves being configured to enable coupling of the respective independent actuators with the respective bearing blocks thereof upon an insertion movement of said respective first sliding members in the respective upper and lower crosspieces.

8. The treatment device according to claim 2, wherein the second sliding member of each of the upper and lower crosspieces includes at least one scraper configured to scrape the laminated strip, the second sliding member engaging with the upper and lower pressure rollers such that each of the at least one scraper is applied in pressure on the laminated strip by said respective upper and lower pressure rollers.

9. The treatment device according to claim 8, wherein the second sliding member comprises a beam having sliding surfaces, parallel and opposite, engaging with corresponding inner surfaces of said side walls, that are parallel, to allow sliding of the second sliding member along the height of the side walls, along a perpendicular direction to the plane of travel of the laminated strip.

10. The treatment device according to claim 2, wherein the upper crosspiece and the lower crosspiece have abutments that are projections directed towards one another at the longitudinal ends of the upper and lower crosspieces, the abutments being distributed laterally on either of the top side or the bottom side of the laminated strip to be dried, in said working position of the upper and lower pressure cylinders, or a working position of at least one scraper configured to scrape the laminated strip, the abutments engaging mutually against one another in the working position of the upper and lower pressure cylinders or the working position of the at least one scraper and defining a slot of defined thickness for the passage of the laminated strip to be dried between the upper crosspiece and the lower crosspiece.

11. The treatment device according to claim 3, wherein the second sliding member of each of the respective upper and lower crosspieces comprises said respective cylinder and chocks rotatably mounted at ends of said respective upper and lower cylinders by bearings, and wherein the second guide system comprises:

sliding surfaces of said chocks, parallel and opposite, on either side of the axis of rotation of said respective cylinder, engaging with corresponding inner surfaces of said side walls, parallel, to allow sliding of the chocks along the height of the side walls, along a perpendicular direction to the plane of travel of the laminated strip, and shoulders of said side walls, proximate to the ends oriented along the side walls, engaging with corresponding shoulders of said chocks, on either side of the axis of rotation of said cylinder, said shoulders of the respective upper and lower crosspieces and the chocks engaging mutually at end-of-travel abutment of the chocks, to ensure that the second sliding member is held in said cavity of the respective upper and lower crosspieces.

12. The treatment device according to claim 2, wherein, for each of the upper and lower crosspieces:

the respective pressure rollers are supported by a plurality of bearing blocks, distributed along the length of said respective pressure cylinder, independent actuators are borne by the upper and lower respective crosspieces distributed along the respective upper and lower crosspieces and engage with said respective bearing blocks, thereby enabling setting of application forces of the respective pressure cylinders only or essentially along a section of length of the respective pressure cylinders in contact with the laminated strip.

13. The treatment device according to claim 3, wherein, for each of the upper and lower crosspieces:

the respective pressure rollers are supported by a plurality of bearing blocks, distributed along the length of said respective pressure cylinder, independent actuators are borne by the respective upper and lower crosspieces distributed along the respective upper and lower crosspieces and engage with said respective bearing blocks, thereby enabling setting of application forces of the respective pressure cylinders only or essentially along a section of length of the respective pressure cylinders in contact with the laminated strip.

14. The treatment device according to claim 4, wherein, for each of the upper and lower crosspieces:

the respective pressure rollers are supported by a plurality of bearing blocks, distributed along the length of said respective pressure cylinder, independent actuators are borne by the respective upper and lower crosspieces distributed along the respective upper and lower crosspieces and engage with said respective bearing blocks, thereby enabling setting of application forces of the respective pressure cylinders only or essentially along a section of length of the respective pressure cylinders in contact with the laminated strip.

15. The treatment device according to claim 6, wherein said respective independent actuators comprise a plurality of fastening ends having a T-shaped cross-section, the fastening ends configured to be inserted into complementary grooves of the respective bearing blocks, oriented along an axis of the respective crosspiece, the fastening ends and the fastening grooves being configured to enable coupling of the respective independent actuators with the respective bearing blocks thereof upon an insertion movement of said respective first sliding members in the respective upper and lower crosspieces.

16. The treatment device according to claim 1, wherein the second sliding member of each of the crosspieces includes at least one scraper configured to scrape the laminated strip, the second sliding member engaging with the upper and lower pressure rollers such that each of the at least one scraper is applied in pressure on the laminated strip by said respective upper and lower pressure rollers.

17. The treatment device according to claim 3, wherein the second sliding member of each of the crosspieces includes at least one scraper configured to scrape the laminated strip, the second sliding member engaging with the upper and lower pressure rollers such that each of the at least one scraper is applied in pressure on the laminated strip by said respective upper and lower pressure rollers.

18. The treatment device according to claim 4, wherein the second sliding member of each of the crosspieces includes at least one scraper configured to scrape the laminated strip, the second sliding member engaging with the upper and lower pressure rollers such that each of the at least one scraper is applied in pressure on the laminated strip by said respective upper and lower pressure rollers.

19. The treatment device according to claim 5, wherein the second sliding member of each of the crosspieces includes at least one scraper configured to scrape the laminated strip, the second sliding member engaging with the upper and lower pressure rollers such that each of the at least one scraper is applied in pressure on the laminated strip by said respective upper and lower pressure rollers.

* * * * *